US010700476B2

(12) United States Patent
Hosoyamada et al.

(10) Patent No.: US 10,700,476 B2
(45) Date of Patent: Jun. 30, 2020

(54) ELECTRICAL CONNECTOR

(71) Applicant: J.S.T. Mfg. Co., Ltd., Tokyo (JP)

(72) Inventors: Go Hosoyamada, Miyoshi (JP); Takashi Tsutsui, Miyoshi (JP)

(73) Assignee: J.S.T. MFG. CO., LTD., Osaka-shi (JP)

( * ) Notice: Subject to any disclaimer, the term of this patent is extended or adjusted under 35 U.S.C. 154(b) by 0 days.

(21) Appl. No.: 16/275,004

(22) Filed: Feb. 13, 2019

(65) Prior Publication Data

US 2019/0252835 A1 Aug. 15, 2019

(30) Foreign Application Priority Data

Feb. 14, 2018 (JP) ..... 2018-023719

(51) Int. Cl.

| | |
|---|---|
| ***H01R 4/66*** | (2006.01) |
| ***H01R 13/6596*** | (2011.01) |
| ***H01R 13/6581*** | (2011.01) |
| *H01R 24/56* | (2011.01) |

(52) U.S. Cl.

CPC ..... *H01R 13/6596* (2013.01); *H01R 13/6581* (2013.01); *H01R 24/568* (2013.01); *H01R 2201/26* (2013.01)

(58) Field of Classification Search

CPC ..... H01R 13/65802; H01R 103/00; H01R 13/635; H01R 13/633

See application file for complete search history.

(56) References Cited

U.S. PATENT DOCUMENTS

| | | | | |
|---|---|---|---|---|
| 9,356,404 | B2 * | 5/2016 | Yu | H01R 13/6594 |
| 9,559,469 | B2 * | 1/2017 | Nishimori | H01R 13/6583 |
| 2016/0315425 | A1 | 10/2016 | Nishimori | |

FOREIGN PATENT DOCUMENTS

| | | | |
|---|---|---|---|
| JP | 4476311 | B2 | 6/2010 |
| JP | 2016-207411 | A | 12/2016 |

* cited by examiner

*Primary Examiner* — Phuong Chi Thi Nguyen

(74) *Attorney, Agent, or Firm* — Kratz, Quintos & Hanson, LLP

(57) ABSTRACT

A housing holds a contact. A shield member is held in the housing and blocks electromagnetic waves, and the contact is arranged inside the shield member. The housing is provided with a ground spring mount portion, which is a portion to which the ground spring member is to be mounted. The ground spring member electrically connects the shield member and an external grounding member when the ground spring member is mounted to the ground spring mount portion.

5 Claims, 9 Drawing Sheets

ELECTRICAL CONNECTOR

CROSS-REFERENCE TO RELATED APPLICATION

This application claims priority to Japanese Patent Application No. 2018-023719. The entire disclosure of Japanese Patent Application No. 2018-023719 is hereby incorporated herein by reference.

BACKGROUND OF THE INVENTION

1. Field of the Invention

The present invention relates to an electrical connector.

2. Description of Related Art

Conventionally, the transmission of video to and from an electrical device for a vehicle has been performed using differential transmission, which is suited to high-speed transmission. A shielded twisted pair cable is one example of a cable used in differential transmission. However, in recent years, coaxial cables have gained attention from the viewpoint of reducing cable weight and cost.

High noise resistance is required when performing video transmission, and therefore coaxial cables need to be grounded to an external grounding member. For example, JP 4476311B and JP 2016-207411A disclose electrical connectors that include a function for grounding to an external grounding member. Note that this requirement is not limited to electrical connectors for coaxial cables, and when any electrical connector is required to have high noise resistance, it is desirable for that electrical connector to have a function for grounding to an external grounding member.

JP 4476311B discloses an electrical connector that includes contacts, an inner housing, an inner shield case, an outer housing, an outer shield case, and an elastic contact piece that is provided on the outer shield case. The inner housing is made of an insulating resin material and holds multiple contacts therein. The inner shield case covers the outer circumferential surfaces of the inner housing, and is connected to the outer shield case. The outer housing is made of an insulating resin material, and is arranged on the outer circumferential surfaces of the inner shield case. The outer shield case covers the outer housing. Also, the elastic contact piece, which is for connection with an external grounding member, is provided on the upper surface of the outer shield case.

JP 2016-207411A discloses an electrical connector that includes signal terminals, a housing, an upper ground terminal, a lower ground terminal, a shell, and a shell ground connection portion that is formed on the upper surface of the shell. The housing is made of an insulating resin material, and holds the signal terminals. The upper ground terminal is a conductive member that is made of a metal, and is held in the housing at a position above the signal terminals. The upper ground terminal has a contacting portion for coming into contact with the shell. The lower ground terminal is held in the housing so as to face the upper ground terminal at a position below the signal terminals. The lower ground terminal is grounded to a substrate. The shell is a conductive member that is made of a metal and covers the housing. The shell ground connection portion is formed as a cut-and-raised portion, and is for connection with an external grounding member.

SUMMARY OF THE INVENTION

With the electrical connector disclosed in JP 4476311B, a portion of the upper surface of the outer shield case is cut out in order to form the elastic contact piece. In other words, a cut-out space is formed in the outer shield case, and sufficient shielding performance cannot be ensured. In view of this, the inner shield case is provided in addition to the outer shield case in order to prevent a decrease in shielding performance.

With the electrical connector disclosed in JP 2016-207411A as well, a portion of the upper surface of the shell is cut and raised in order to form the shell ground connection portion. A cut-out space is therefore formed in the shell, and sufficient shielding performance cannot be ensured. In view of this, the upper ground terminal and the lower ground terminal are provided inside the shell in order to prevent a decrease in shielding performance.

However, multiple members for blocking electromagnetic waves are provided in these electrical connectors in order to block the cut-out spaces formed by cutting and raising. In order for these members to block electromagnetic waves, it is necessary to ground them to each other and form ground lines, thus resulting in a more complex structure. The inclusion of these members also has a problem of making it difficult to reduce the size of the electrical connector.

As mentioned above, when high noise resistance is required, an electrical connector needs to have a grounding function for grounding with an external grounding member. However, if an electrical connector capable of achieving a grounding function is also configured to also be capable of being easily used when high noise resistance is not required and the grounding is function is not necessary, it is possible to improve the versatility and the user-convenience of the electrical connector. Accordingly, there is desire for the realization of an electrical connector having a configuration that enables selectively achieving a grounding function according to need.

In light of the above-described circumstances, an object of the present invention is to provide an electrical connector that can have a simplified structure and small size, while also enabling selectively achieving a grounding function according to need without causing a decrease in shielding performance.

(1) An electrical connector according to an aspect of the present invention for achieving the foregoing object includes: a contact; a housing configured to hold the contact; a shield member configured to be held in the housing and block electromagnetic waves, the contact being arranged inside the shield member; and a ground spring member configured to ground the shield member, wherein a ground spring mount portion is provided in the housing, the ground spring mount portion being a portion to which the ground spring member is mounted, and the ground spring member is configured to electrically connect the shield member and an external grounding member when the ground spring member is mounted to the ground spring mount portion.

According to this configuration, in the electrical connector, the ground spring mount portion is provided in the housing, and when the ground spring member is mounted to the ground spring mount portion, the ground spring member can electrically connect the shield member and the external grounding member. Specifically, the shield member is not grounded to the external grounding member when the separate ground spring member is not mounted, but is grounded to the external grounding member when the separate ground spring member is mounted. Accordingly, it is possible to select, according to need, whether to configure an electrical connector that does not have the ground spring member mounted thereto and does not have a grounding function, or an electrical connector that has the ground spring member mounted thereto and has a grounding function. Also, it is possible to use the same necessary manufacturing equipment and the like in steps other than the step for attaching the ground spring member, thus making it possible to reduce manufacturing cost.

Also, the ground spring member is a separate member, thus eliminating the need to provide a member for grounding by cutting and raising a portion of the shield member, and therefore a cut-out space that allows the intrusion of electromagnetic waves is not formed in the shield member. Accordingly, a gap that allows the intrusion of electromagnetic waves does not exist in the region surrounding the contact, thus more reliably blocking electromagnetic waves that attempt to intrude into the shield member. Accordingly, a reduction in the shielding performance of the electrical connector can be prevented.

Furthermore, a space that allows the intrusion of electromagnetic waves is not formed in the shield member as described above, thus eliminating the need for a mechanism for blocking such a space. In other words, there is no need to provide multiple shield members, and the structure of the electrical connector can be simplified. It is also possible to achieve an even smaller size for the electrical connector.

Therefore, according to the above configuration, it is possible to provide an electrical connector that can have a simplified structure and small size, while also enabling selectively achieving a grounding function according to need without causing a decrease in shielding performance.

(2) A configuration is possible in which the ground spring member has a main body portion that has a portion that is plate-shaped and configured to be mounted to the housing, and a plate spring portion that is provided integrated with the main body portion and is configured to come into contact with the external grounding member, and the main body portion is configured to come into contact with the shield member.

According to this configuration, in the electrical connector, the ground spring member has the plate spring portion that is integrated with the main body portion and comes into contact with the external grounding member when the ground spring member is mounted to the housing. For this reason, when the electrical connector is used in the state where the ground spring member is connected to the external grounding member, the plate spring portion of the ground spring member and the external grounding member are in contact with each other due to the elastic force of the plate spring portion. Accordingly, the grounded state can be stably maintained even if vibration occurs in the electrical connector and the external grounding member. Also, according to the above configuration, the ground spring member has a structure that enables stably maintaining the grounded state even when vibration occurs, and this structure can be realized as a simple structure in which the plate spring portion is provided integrated as a single body with the main body portion.

(3) A configuration is possible in which a press-fit groove configured to receive press-fitting of the main body portion is provided in the ground spring mount portion.

According to this configuration, in the electrical connector, the main body portion is configured to be press-fitted into the press-fit groove. For this reason, when the ground spring member is mounted to the ground spring mount portion provided in the housing, an operator who performs this mounting operation only needs to simply push the ground spring member into the ground spring mount portion, and therefore can easily mount the ground spring member. Also, the ground spring member is reliably held in the ground spring mount portion by being press-fitted therein, thus making it possible to also prevent it from coming out due to vibration or the like.

(4) A configuration is possible in which the main body portion has a plate-shaped portion configured as the portion that is plate-shaped, and a contacting spring portion that extends from the plate-shaped portion in a cantilevered manner, and that is configured to come into contact with the shield member.

According to this configuration, the main body portion of the ground spring member is provided with the contacting spring portion that extends from the plate-shaped portion in a cantilevered manner and is for coming into contact with the shield member. For this reason, the ground spring member is pressed against the shield member by the spring force of the contacting spring portion, and can be stably maintained in a state of contact with the shield member. Also, according to the above configuration, the ground spring member has a structure that enables stably maintaining a state of contact with the shield member, and this structure can be realized as a simple structure in which the main body portion is provided with a portion that extends from the plate-shaped portion in a cantilevered manner.

(5) A configuration is possible in which the housing has a support portion that is provided with a flat surface configured to support the main body portion.

According to this configuration, in the electrical connector, the main body portion of the ground spring member is supported by the flat surface of the support portion that is provided in the housing. Accordingly, the main body portion is reliably supported in the housing in a stable state through surface contact. Also, due to being supported in a stable state through surface contact, the main body portion is not likely to be influenced by external forces such as vibration, and can be easily maintained in a state of being stably grounded to the external grounding member and the shield member.

Note that the above and other objects, features, and advantages of this invention will become apparent by reading the following description with the attached drawings.

DETAILED DESCRIPTION OF THE INVENTION

Hereinafter, embodiments for carrying out the present invention will be described with reference to the drawings.

First Embodiment

Overview of Electrical Connector

Figure 1:
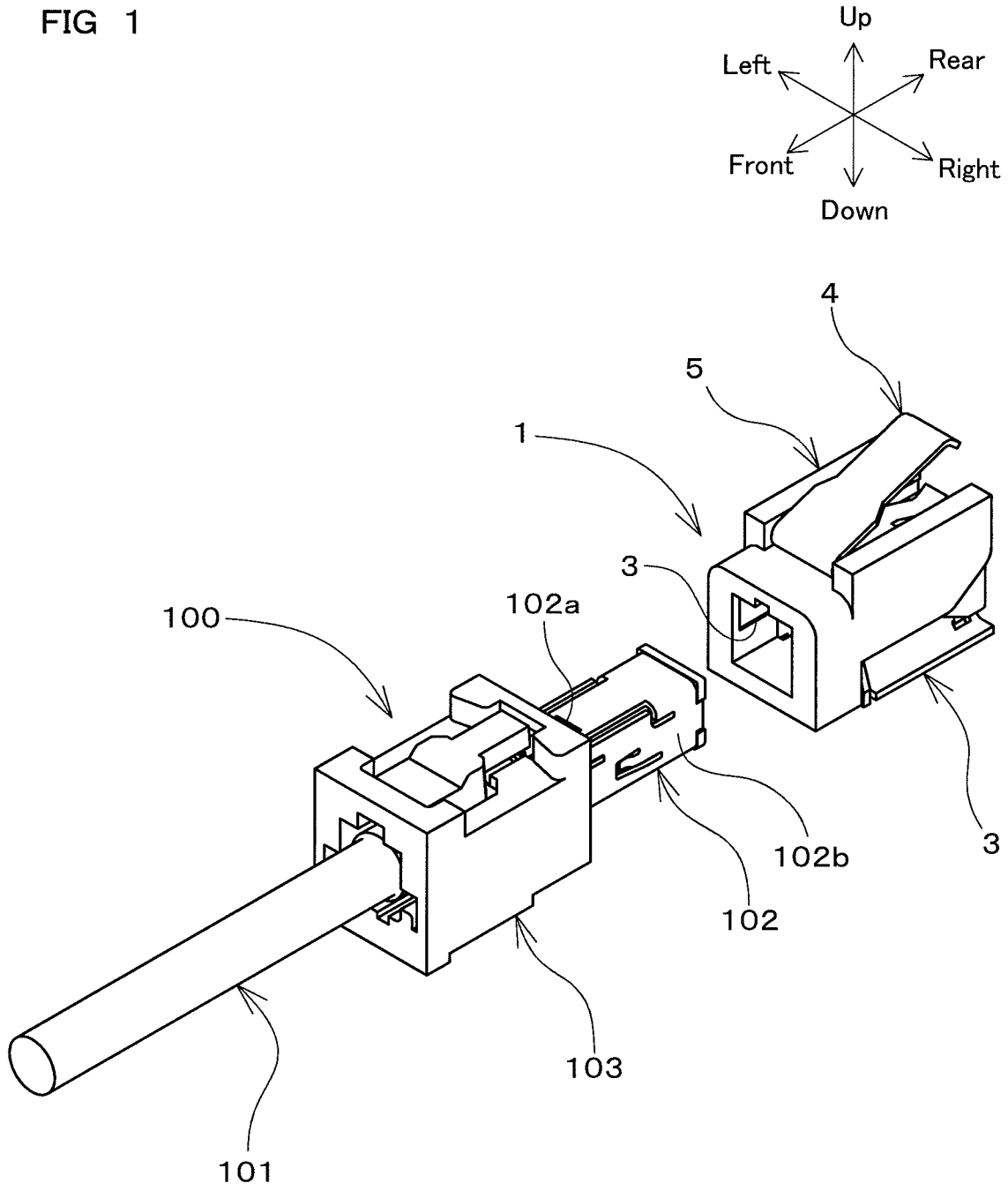
FIG. 1 is a perspective diagram showing an electrical connector according to a first embodiment of the present invention.
Figure 2:
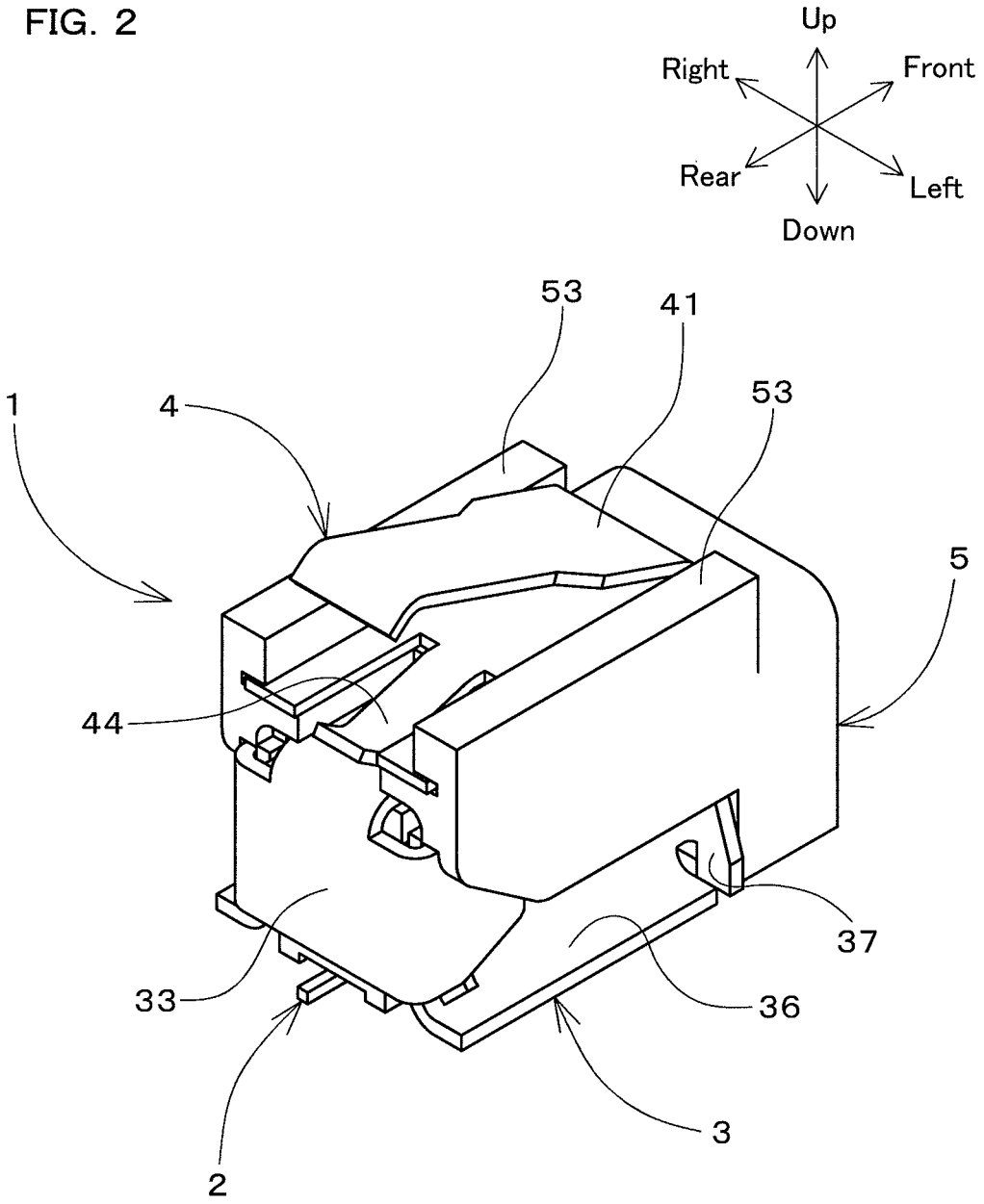
FIG. 2 is a perspective diagram showing the electrical connector shown in FIG. 1, as seen from the rear side.
Figure 3:
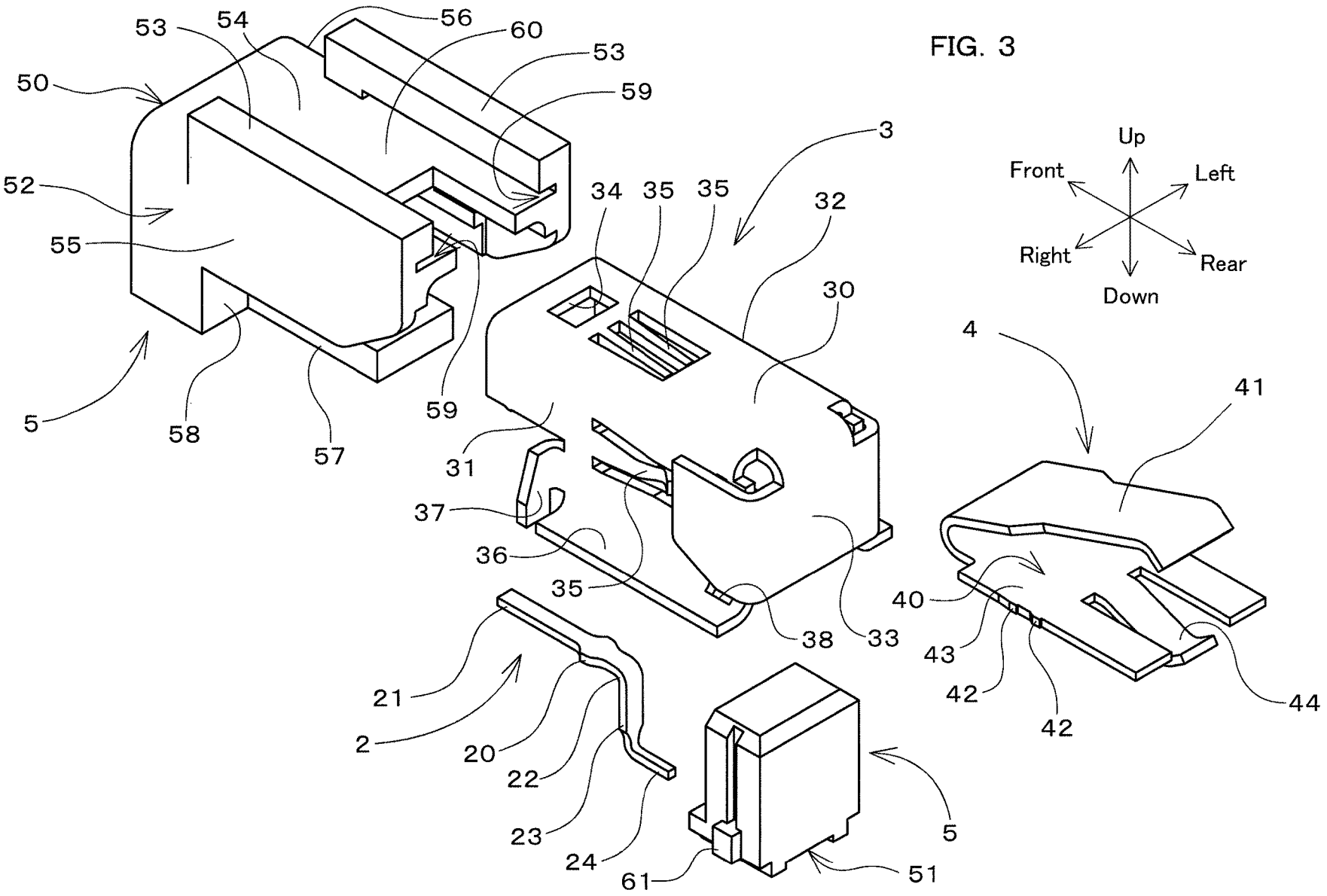
FIG. 3 is a perspective diagram showing an exploded state of the electrical connector shown in FIG. 1.

FIG. 1 is a perspective diagram showing an electrical connector 1 according to a first embodiment of the present invention, and also showing a partner connector 100 for connection thereto. Also, FIG. 1 shows a state before connection of the electrical connector 1 and the partner connector 100. FIG. 2 is a perspective diagram showing the electrical connector 1 as seen from the rear side. FIG. 3 is a perspective diagram showing an exploded state of the electrical connector 1.

Note that in FIGS. 1, 2, and 3, as well as the figures mentioned later, for convenience in the description, "rightward" refers to the direction indicated by the arrow denoted by "right", "leftward" refers to the direction indicated by the arrow denoted by "left", "upward" and "upper" refer to the direction indicated by the arrow denoted by "up", "downward" and "lower" refer to the direction indicated by the arrow denoted by "down", "forward" and "front" refer to the direction indicated by the arrow denoted by "front", and "rearward" and "rear" refer to the direction indicated by the arrow denoted by "rear". It should also be noted that the up-down direction in the electrical connector 1 is the height direction of the electrical connector 1, and the left-right direction in the electrical connector 1 is the width direction of the electrical connector 1. Also, in the present embodiment, the direction in which the partner connector 100 is mated to the electrical connector 1 (mating direction) is the direction from the front side of the electrical connector 1 to the rear side thereof. Moreover, the direction in which the partner connector 100 is withdrawn from the electrical connector 1 (withdrawal direction) is the direction from the rear side of the electrical connector 1 to the front side thereof.

The electrical connector 1 shown in FIG. 1 is a so-called side-type connector, which is connected to a substrate on the lower side and connected to an electrical cable 101 via the partner connector 100 on the front side. Note that the substrate is not depicted in the drawings. The electrical connector 1 includes a contact 2; a housing 5 that holds the contact 2; a shield member 3 that is held in the housing 5, blocks electromagnetic waves, and has the contact 2 arranged therein; and a ground spring member 4 for grounding the shield member 3.

Figure 4B:
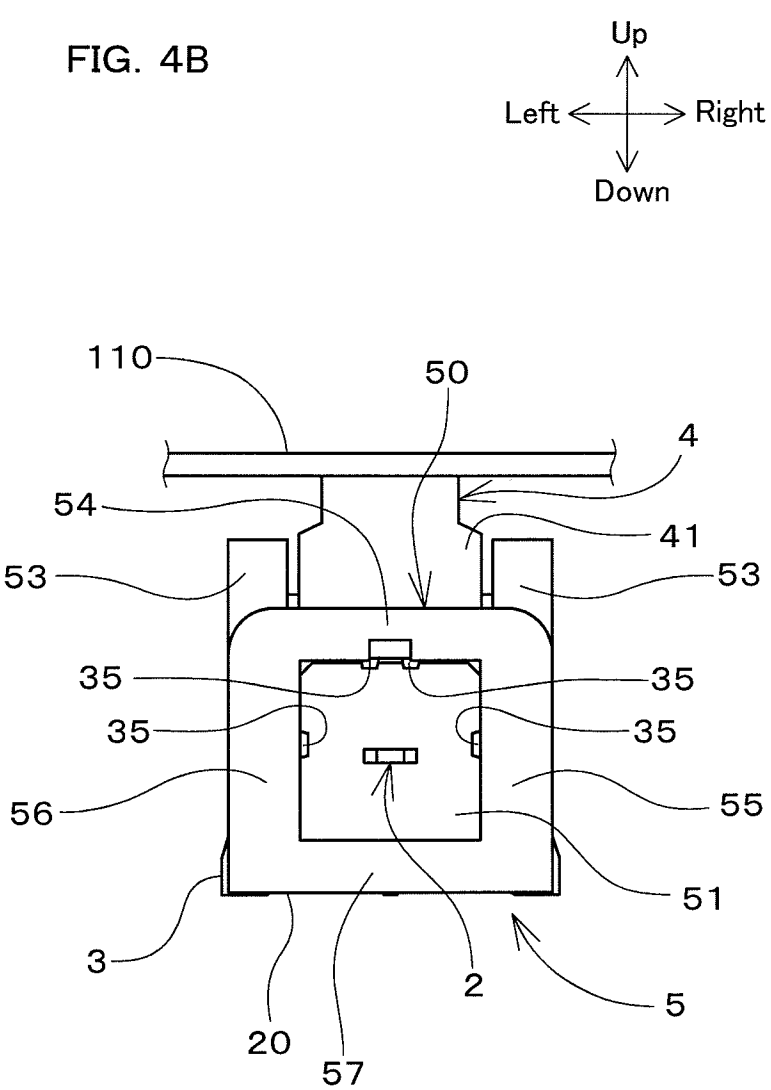
FIGS. 4A and 4B are front views of the electrical connector shown in FIG. 1, with FIG. 4A showing a state before grounding to an external grounding member, and FIG. 4B showing a state where the electrical connector is grounded to the external grounding member.
Figure 4A:
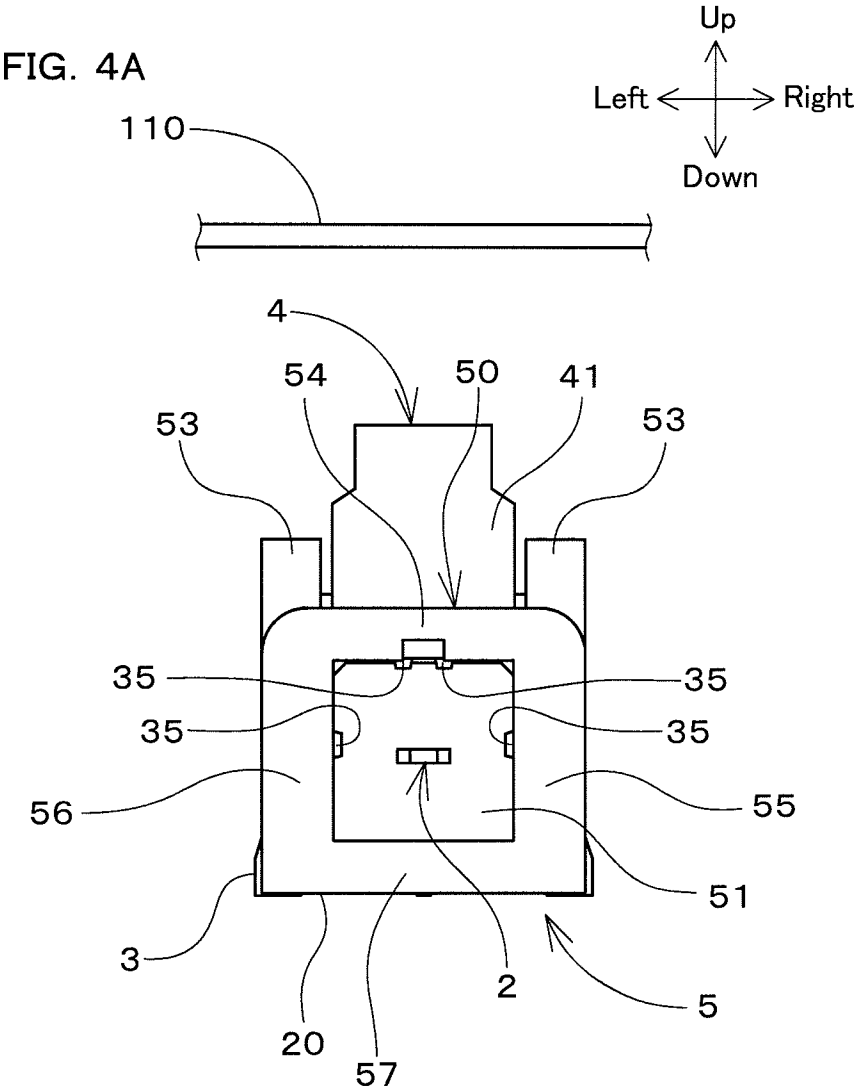

The electrical connector 1 is connected to the substrate on the lower side, is connected to the partner connector 100 on the front side, and is grounded to an external grounding member 110 on the upper side. Note that FIGS. 4A and 4B are front views of the electrical connector 1, with FIG. 4A showing a state before grounding to the external grounding member 110, and FIG. 4B showing a state where the electrical connector 1 is grounded to the external grounding member 110. The external grounding member 110 is provided as a portion of a case that is not depicted in the drawings. The case that is provided with the grounding member 110 is provided as, for example, a housing case that is attached to the substrate and internally houses components located on the substrate, including the electrical connector 1 that is to be connected to the substrate. Note that FIGS. 4A and 4B show a portion of the grounding member 110 that is provided in the case. Due to the electrical connector 1 being electrically and mechanically connected to the substrate, and the case being attached to the substrate, the grounding member 110 provided in the case is arranged so as to be in contact with the ground spring member 4 that is mounted to the upper side of the housing 5 of the electrical connector 1. The partner connector 100 is then connected to the electrical connector 1 that is connected to the substrate.

Note that the partner connector 100 is connected to the electrical cable 101, which is configured as a coaxial cable for example. The partner connector 100 has a partner shield member 102, a partner housing 103, and a partner contact. Note that the partner contact does not appear in the drawings. The electrical cable 101 is configured to include a conductive body and an insulating covering that surrounds the conductive body. Note that in the case of being configured as a coaxial cable, the electrical cable 101 is configured to include an inner conductive body, an insulating member that surrounds the inner conductive body, an outer conductive body that surrounds the insulating member, and an insulating covering that surrounds the outer conductive body. The partner shield member 102 is constituted by a conductive member that is made of a metal, and blocks electromagnetic waves arriving from the outside. The partner housing 103 is constituted by an insulating resin material, and has the partner shield member 102 provided on one end side. The partner housing 103 is configured to receive connection of the electrical cable 101 on the other end side. The partner contact is provided inside the partner shield member 102, and is configured so as to be connected to the contact 2 of the electrical connector 1 by being mated thereto. Note that the partner shield member 102 has an engaging protrusion portion 102*a* for engagement with a later-described engaging hole portion 34 of the shield member 3, and a wall surface portion 102*b* for coming into contact with, and receiving elastic force from, a later-described elastic contacting piece 35 of the shield member 3.

Contact

Figure 5:
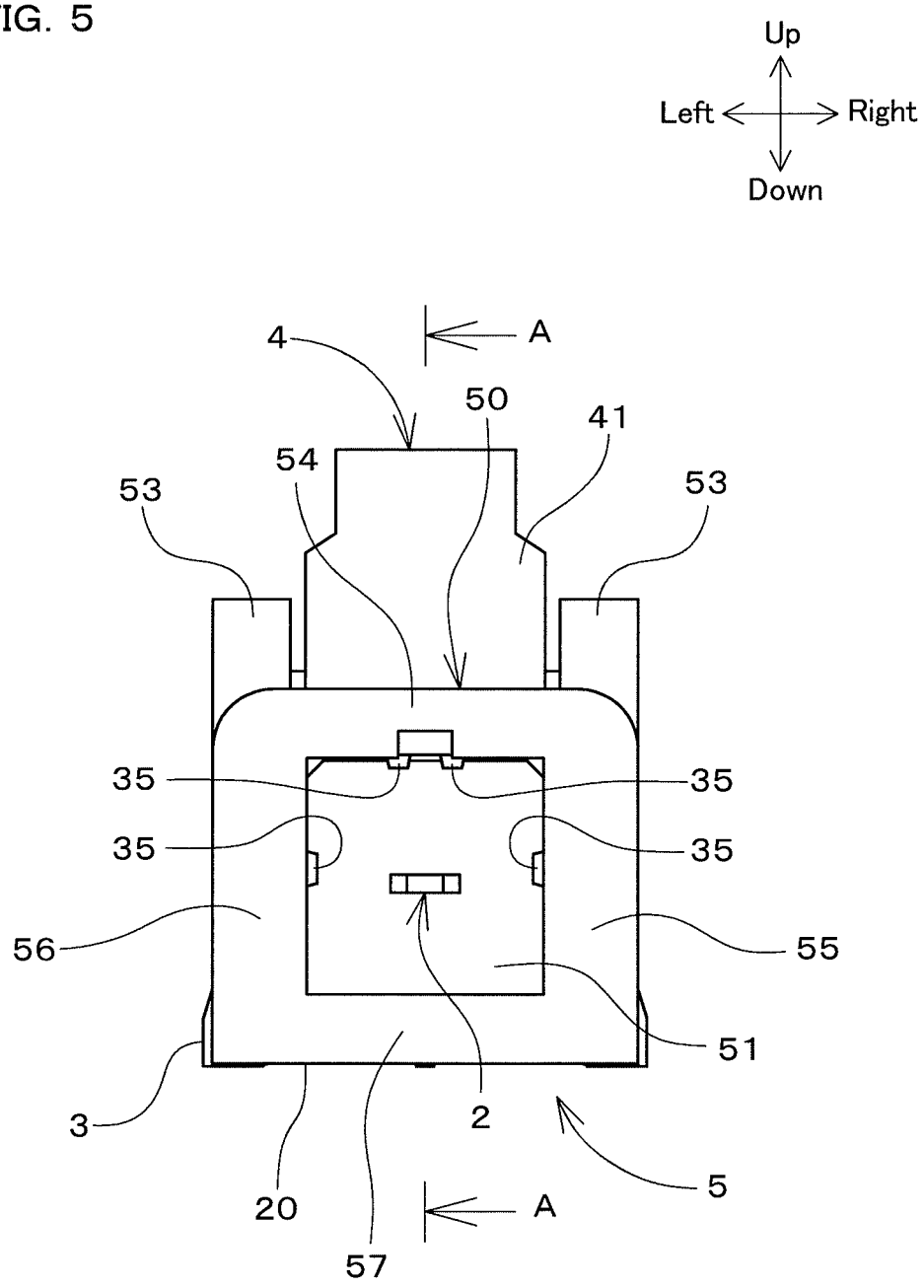
FIG. 5 is a front view of the electrical connector shown in FIG. 1.
Figure 6:
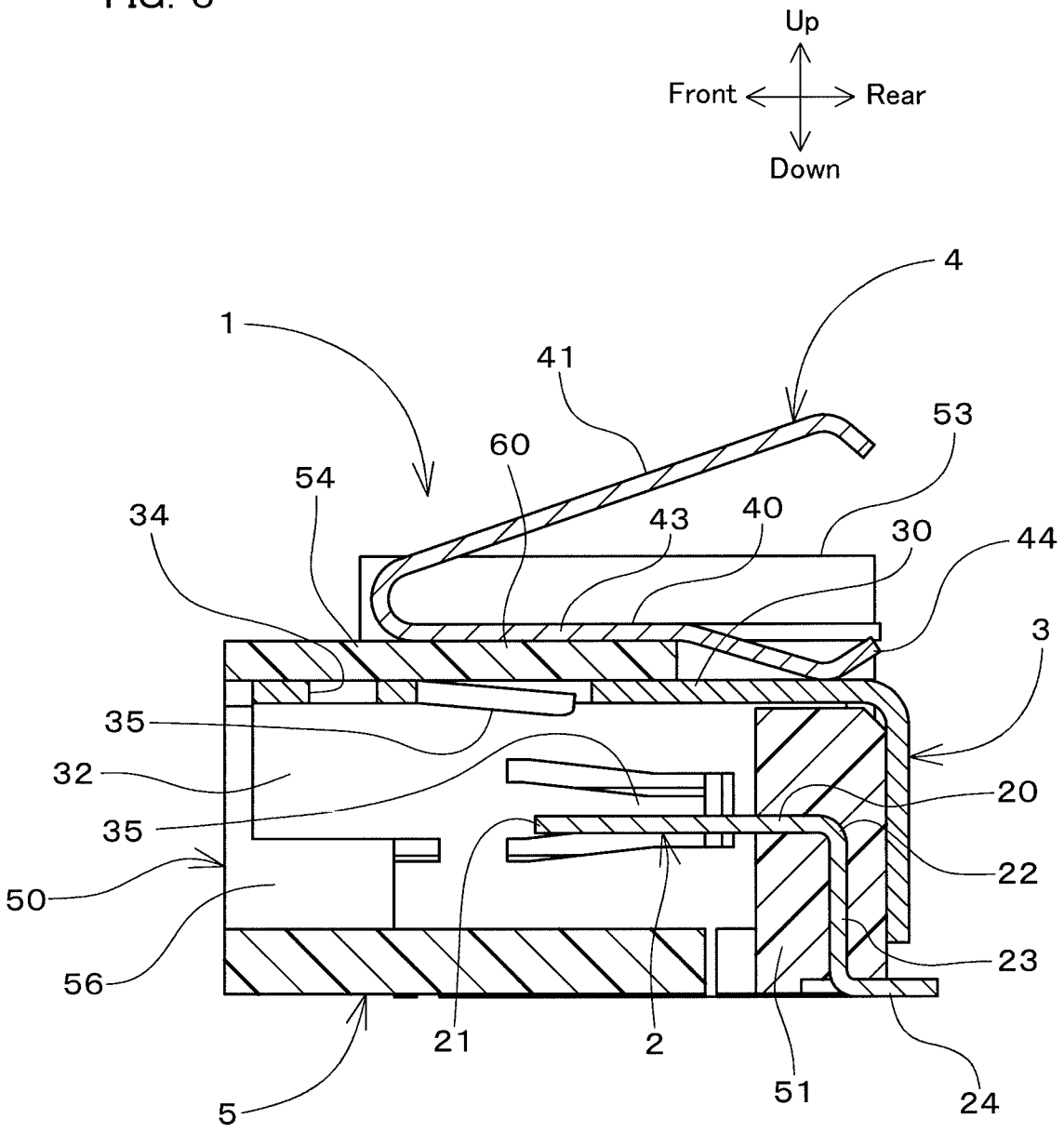
FIG. 6 is a cross-sectional diagram showing a cross-section of the electrical connector shown in FIG. 5 taken along a line A-A and viewed in a direction along the arrows.
Figure 7:
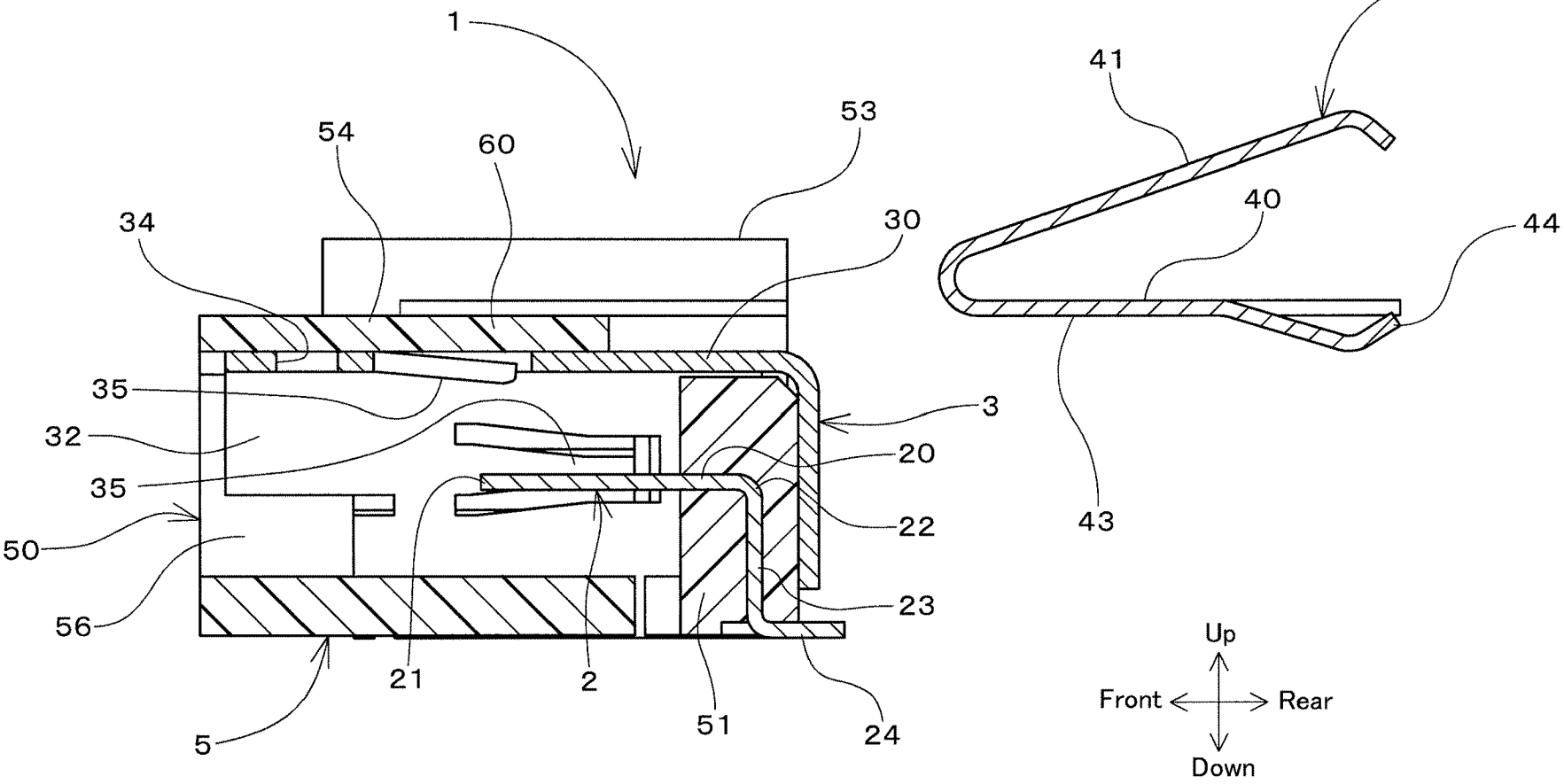
FIG. 7 is a cross-sectional view of the electrical connector shown in FIG. 6, and shows a state before a ground spring member is mounted.

FIG. 5 is a front view (front side view) of the electrical connector 1. FIG. 6 is a cross-sectional diagram showing a cross-section of the electrical connector 1 shown in FIG. 5 taken along a line A-A and viewed in a direction along the arrows. FIG. 7 is a cross-sectional view of the electrical connector 1 shown in FIG. 6, and shows a state before the ground spring member 4 is mounted.

The contact 2 shown in FIGS. 3 to 7 is constituted by a flat plate-shaped conductive member that is made of a metal, and has a contact main body portion 20, a contact portion 21, a curved portion 22, an extending portion 23, and a substrate connection portion 24.

The contact main body portion 20 of the present embodiment is formed with a shape that has a portion that bulges in the left-right direction, and is attached to the later-described inner housing 51 by insert molding. The contact portion 21 is provided on the front side of the contact main body portion 20, and extends in the front-rear direction, along the longitudinal direction of the shield member 3.

The curved portion 22 extends while curving downward on the rear side on the contact main body portion 20. The extending portion 23 extends downward from the curved portion 22. The substrate connection portion 24 is provided so as to curve rearward from the lower end of the extending portion 23, and to extend substantially parallel with the substrate when the electrical connector 1 is connected to the substrate. The substrate connection portion 24 is configured to be electrically and mechanically connected to the substrate by soldering. Note that the contact 2 of the present embodiment is configured by a flat plate-shaped pin, but may have another shape, such as having a tubular shape.

Shield Member

The shield member 3 shown in FIGS. 2 to 7 is formed by performing punch processing, fold processing, and the like on a flat plate-shaped conductive member that is made of a metal. The shield member 3 is formed so as to surround the contact 2, and is configured to be capable of blocking electromagnetic waves that arrive from the outside. Specifically, the shield member 3 can prevent the intrusion of electromagnetic waves arriving from the outside, such that the contact 2 arranged inside the shield member 3 is not influenced by electromagnetic waves. Also, the shield member 3 is held in the housing 5. The shield member 3 is configured such that the partner shield member 102, which blocks electromagnetic waves, of the partner connector 100 can be inserted into the shield member 3.

The shield member 3 has an upper wall portion 30 that covers the upper side of the contact 2, a right wall portion 31 that covers the right side, a left wall portion 32 that covers the left side, and a rear wall portion 33 that covers the rear side. Note that the front side and the lower side of the shield member 3 are open.

The upper wall portion 30 is integrated with the right wall portion 31 in the right side end portion, and is integrated with the left wall portion 32 in the left side end portion. The upper wall portion 30 is also integrated with the rear wall portion 33 on the rear side. The upper wall portion 30 has an engaging hole portion 34 on the front side for engagement with an engaging protrusion portion 102*a* of the partner shield member 102, and is configured to be capable of engagement with the partner shield member 102. The upper wall portion 30 furthermore has a pair of cantilevered elastic contacting pieces 35 at positions on the forward side of a central portion in the front-rear direction.

The right wall portion 31 has a right-wall lower portion 36 that curves outward in a lower end portion, and that extends substantially parallel with the substrate when the electrical connector 1 is connected to the substrate. The right wall portion 31 also has a right-wall front portion 37 that curves outward and extends rightward in a frontward portion on the lower side. The right wall portion 31 has a cantilevered elastic contacting piece 35 in a substantially central portion, and this cantilevered elastic contacting piece 35 is for coming into contact with the wall surface portion 102*b* of the partner shield member 102. Note that the right wall portion 31 is provided with a fixing hole 38 on the rear side, and this fixing hole 38 receives insertion of a later-described fixing tool 61 of the inner housing 51.

Similarly to the right wall portion 31, the left wall portion 32 has a left-wall lower portion 36 that curves outward in a lower end portion, and that extends substantially parallel with the substrate when the electrical connector 1 is connected to the substrate. The left wall portion 32 also has a left-wall front portion 37 that curves outward and extends leftward in a frontward portion on the lower side. Note that the left wall portion 32 is not depicted in this drawing. The left wall portion 32 also has a cantilevered elastic contacting piece 35 in a substantially central portion, and this cantilevered elastic contacting piece 35 is for coming into contact with the wall surface portion 102*b* of the partner shield member 102.

The rear wall portion 33 is provided so as to surround the rear side of the contact 2. Also, the two end portions of the rear wall portion 33 in the left-right direction are formed so as to curve forward, and cover the rear sides of the right wall portion 31 and the left wall portion 32. Specifically, the size of the rear wall portion 33 in the left-right direction before bend processing is larger than the gap between the right wall portion 31 and the left wall portion 32 of the shield member 3 after bend processing. After the bend processing, the two end portions of the rear wall portion 33 curve forward so as to overlap the rear sides of the right wall portion 31 and the left wall portion 32.

Ground Spring Member

The ground spring member 4 shown in FIGS. 1 to 7 is configured to electrically connect the shield member 3 to the external grounding member 110 when mounted to later-described ground spring mount portions 53. The ground spring member 4 is formed by performing bend processing on a flat plate-shaped conductive member that is made of a metal. The ground spring member 4 has a main body portion 40, which has a plate-shaped portion for mounting to the housing 5, and a plate spring portion 41 that is integrated with the main body portion 40 and is for coming into contact with the external grounding member 110. Note that the ground spring member 4 is separate from the shield member 3, and therefore can made of a different material than the shield member 3.

The main body portion 40 of the ground spring member 4 shown in FIGS. 3, 6, and 7 is substantially shaped as a flat plate, and is for coming into contact with the shield member 3. The left and right end surfaces of the main body portion 40 are each provided with an engaging projection 42 for engagement with the housing 5 when the main body portion 40 is press-fitted into the housing. The main body portion 40 also has a plate-shaped portion 43, which is configured as a plate-shaped portion for mounting to the housing 5, and a contacting spring portion 44, which extends from the plate-shaped portion 43 in a cantilevered manner and is for coming into contact with the shield member 3.

The plate spring portion 41 shown in FIGS. 1 to 7 has one end side that is integrated with the main body portion 40, and extends diagonally upward so as to move away from the main body portion 40 while extending toward the leading end. The width of the plate spring portion 41 is smaller on the leading end side of the approximately central portion in the front-rear direction than on the base end side. The leading end portion of the plate spring portion 41 has been bent toward the main body portion 40.

Also, as shown in FIGS. 4A and 4B, the electrical connector 1 of the present embodiment is grounded by the external grounding member 110 approaching the plate spring portion 41 from above. When the plate spring portion 41 and the external grounding member 110 are in the grounded state, the plate spring portion 41 is in contact with the external grounding member 110 due to the elastic force of the plate spring portion 41. Accordingly, the grounded state can be stably maintained even if vibration occurs in the electrical connector 1 and the external grounding member 110.

The engaging projections 42 shown in FIG. 3 are provided in approximately central portions of the left and right end surfaces of the main body portion 40. When the main body portion 40 is press-fitted into later-described press-fit grooves 59 of the housing 5, the engaging projections 42 of the main body portion 40 become engaged with engaging grooves (not depicted) provided in the press-fit grooves 59. The ground spring member 4 is fixed to the housing 5 by press-fitting, and is arranged on the upper side of the shield member 3 and the upper side of the housing 5. The ground spring member 4 fixed to the housing 5 is arranged spaced apart from the housing 5 on the upper side of the upper wall portion 30 of the shield member 3 such that the main body portion 40 of the ground spring member 4 is substantially parallel with the upper wall portion 30.

The contacting spring portion 44 shown in FIGS. 2, 3, 6, and 7 is formed with a cantilevered shape by performing cutting processing in the approximately central portion, with respect to the left-right direction, of the rear side of the main body portion 40. The contacting spring portion 44 has been bent toward the shield member 3 at the base, and has been bent away from the shield member 3 at the leading end portion. For this reason, the ground spring member 4 for grounding to the external grounding member 110 is connected to the shield member 3 when mounted to the housing 5. In other words, the shield member 3 can be connected to the external grounding member 110 via the ground spring member 4 without needing to perform cutting processing, and therefore a cut-out space is not formed in the shield member 3. Note that in the description given below, the state where the ground spring member 4 has been mounted to the housing 5, and furthermore the ground spring member 4 is connected to the shield member 3, will be referred to as the mounted state of the ground spring member 4.

Housing

The housing 5 shown in FIGS. 1 to 7 is configured to include an outer housing 50 that is provided outside the shield member 3, and an inner housing 51 that holds the contact 2 and is provided inside the shield member 3.

The outer housing 50 of the housing 5 is provided with an outer housing main body portion 52 that houses the shield member 3, and ground spring mount portions 53 for mounting of the ground spring member 4.

The outer housing main body portion 52 includes a first wall portion 54 provided on the upper side, a second wall portion 55 provided on the right side, a third wall portion 56 provided on the left side, and a fourth wall portion 57 provided on the lower side. The housing main body portion 52 is configured so as to cover the shield member 3.

An opening portion for arrangement of the contacting spring portion 44 of the ground spring member 3 is formed in the rear side of the first wall portion 54. A cutout region 58 for arrangement of the right-wall lower portion 36 and the right-wall front portion 37 of the shield member 3 is formed at the lower side of the second wall portion 55. Similarly to the second wall portion 55, a cutout region 58 for arrangement of the left-wall lower portion 36 and the left-wall front portion 37 of the shield member 3 is formed at the lower side of the third wall portion 56. The left and right end portions on the front side of the fourth wall portion 57 are integrated with the second wall portion 55 and the third wall portion 56, and the fourth wall portion 57 extends in the front-rear direction so as to block the lower side of the shield member 3.

The ground spring mount portions 53 are provided as a pair of portions that project upward respectively at the left and right ends on the upper side of the first wall portion 54 of the housing 5, and the ground spring mount portions 53 have a pair of press-fit grooves 59 that face each other in the inward surfaces that face each other. In other words, a press-fit groove 59 is provided in each of the two ground spring mount portions 53. According to this configuration, the housing 5, which includes the ground spring mount portions 53, is provided with the press-fit grooves 59 into which the main body portion 40 of the ground spring member 4 is to be press-fitted. Note that the main body portion 40 of the ground spring member 4 is fixed by being press-fitted into the press-fit grooves 59.

The press-fit grooves 59 are provided at the bottom of the inward sides of the pair of ground spring mount portions 53 that face each other. The press-fit grooves 59 of the present embodiment are formed with shapes that correspond to the shapes of the left and right end portions of the plate-shaped main body portion 40. The press-fit grooves 59 are formed such that the plate-shaped main body portion 40 is arranged parallel with the shield member 3 when press-fitted into the press-fit grooves 59. Also, the press-fit grooves 59 are open on the rear side, thus enabling the ground spring member 4 to be inserted and removed from the rear side, and the press-fit grooves 59 are closed on the front side, thus being capable of fixing the ground spring member 4 at a predetermined positioned. Note that the press-fit grooves 59 may be configured such that the front side is not closed, thus enabling insertion and removal on both the front side and rear side.

The press-fit grooves 59 are formed with a constant depth in correspondence with the size of the ground spring member 4 in the left-right direction. For this reason, the ground spring member 4 may be configured to be inserted into the press-fit grooves 59 in the direction opposite to the direction shown in FIGS. 6 and 7. Note that in this case, the opening portion that is provided in the first wall portion 54 for arrangement of the contacting spring portion 44 of the ground spring member 3 needs to be formed with a larger size.

Also, the outer housing 50 has a support portion 60 that is constituted as part of the first wall portion 54 that has a flat surface and is provided with the ground spring mount portions 53 having the press-fit grooves 59 at the left and right ends. The support portion 60, which is constituted as part of the first wall portion 54, is provided with a flat surface for supporting the main body portion 40 of the ground spring member 4. Accordingly, in the present embodiment, the housing 5 has the support portion 60 that is provided with a flat surface for supporting the main body portion 40. Note that the main body portion 40 supports the support portion 60 in the state where the main body portion 40 is in surface contact with the flat surface of the support portion 60.

The inner housing 51 holds the contact 2 in the electrical connector 1, and is provided at the rear side in the shield member 3. Fixing portions 61 for fixing the shield member 3 are provided on side surfaces of the inner housing 51. The housing 5 of the present embodiment is constituted by two components, namely the outer housing 50 and the inner housing 51, but an aspect is possible in which the housing 5 is constituted by one component.

Actions and Effects of Present Embodiment

According to the present embodiment, in the electrical connector 1, the ground spring mount portions 53 are provided in the housing 5, and when the ground spring member 4 is mounted to the ground spring mount portions 53, the ground spring member 4 can be electrically connected to the shield member 3 and the external grounding member 110. Specifically, when the separate ground spring member 4 is not mounted, the shield member 3 is not grounded to the external grounding member 110, whereas when the separate ground spring member 110 has been mounted, the shield member 3 is grounded to the external grounding member 110. Accordingly, it is possible to select, according to need, whether to configure the electrical connector 1 that does not have the ground spring member 4 mounted thereto and does not have a grounding function, or the electrical connector 1 that has the ground spring member 4 mounted thereto and has a grounding function. Also, it is possible to use the same necessary manufacturing equipment and the like in steps other than the step for attaching the ground spring member 4, thus making it possible to reduce manufacturing cost.

Also, according to the present embodiment, the ground spring member 4 is a separate member, thus eliminating the need to provide a member for grounding by cutting and raising a portion of the shield member, and therefore a cut-out space that allows the intrusion of electromagnetic waves is not formed in the shield member 3. Accordingly, a gap that allows the intrusion of electromagnetic waves does not exist in the region surrounding the contact 2, thus more reliably blocking electromagnetic waves that attempt to intrude into the shield member 3. Accordingly, a reduction in the shielding performance of the electrical connector 1 can be prevented.

Furthermore, according to the present embodiment, a space that allows the intrusion of electromagnetic waves is not formed in the shield member 3 as described above, thus eliminating the need for a mechanism for blocking such a space. In other words, there is no need to provide multiple shield members 3, and the structure of the electrical connector 1 can be simplified. It is also possible to achieve an even smaller size for the electrical connector 1.

Therefore, according to the present embodiment, it is possible to provide the electrical connector 1 that can have a simplified structure and small size, while also enabling selectively achieving a grounding function according to need without causing a decrease in shielding performance.

Also, according to the present embodiment, in the electrical connector 1, the ground spring member 4 has the plate spring portion 41 that is integrated with the main body portion 40 and comes into contact with the external grounding member 110 when the ground spring member 4 is mounted to the housing 5. For this reason, when the electrical connector 1 is used in the state where the ground spring member 4 is connected to the external grounding member 110, the plate spring portion 41 of the ground spring member 4 and the external grounding member 110 are in contact with each other due to the elastic force of the plate spring portion 41. Accordingly, the grounded state can be stably maintained even if vibration occurs in the electrical connector 1 and the external grounding member 110. Also, according to the present embodiment, the ground spring member 4 has a structure that enables stably maintaining the grounded state even when vibration occurs, and this structure can be realized as a simple structure in which the plate spring portion 41 is provided integrated as a single body with the main body portion 40.

Also, according to the present embodiment, in the electrical connector 1, the main body portion 40 is configured to be press-fitted into the press-fit grooves 59. For this reason, when the ground spring member 4 is mounted to the ground spring mount portions 53 provided in the housing 5, the operator who performs this mounting operation only needs to simply push the ground spring member 4 into the ground spring mount portions 53, and therefore can easily mount the ground spring member 4. Also, the ground spring member 4 is reliably held in the ground spring mount portions 53 by being press-fitted therein, thus making it possible to also prevent it from coming out due to vibration or the like.

Also, according to the present embodiment, the main body portion 40 of the ground spring member 4 is provided with the contacting spring portion 44 that extends from the plate-shaped portion 43 in a cantilevered manner and is for coming into contact with the shield member 3. For this reason, the ground spring member 4 is pressed against the shield member 3 by the spring force of the contacting spring portion 44, and can be stably maintained in a state of contact with the shield member 3. Also, according to the present embodiment, the ground spring member 4 has a structure that enables stably maintaining a state of contact with the shield member 3, and this structure can be realized as a simple structure in which the main body portion 40 is provided with a portion that extends from the plate-shaped portion 43 in a cantilevered manner.

Also, according to the present embodiment, in the electrical connector 1, the main body portion 40 of the ground spring member 4 is supported by the flat surface of the support portion 60 that is provided in the housing 5. Accordingly, the main body portion 40 is reliably supported in the housing 5 in a stable state through surface contact. Also, due to being supported in a stable state through surface contact, the main body portion 40 is not likely to be influenced by external forces such as vibration, and can be easily maintained in a state of being stably grounded to the external grounding member 110 and the shield member 3.

Second Embodiment

Next, a second embodiment of the present invention will be described. Whereas the above first embodiment illustrates an example of a so-called side-type electrical connector 1 that is mated in the left-right direction, the present embodiment describes a so-called top-type electrical connector 1A that is mated in the up-down direction. Note that the following mainly describes differences from the first embodiment, and configurations that are similar to those of the first embodiment are denoted by similar reference signs in the drawings, and will not be described in detail.

In the present embodiment, the direction in which a partner connector (not depicted) is mated to the electrical connector 1A (i.e., the mating direction) is the direction from the upper side of the electrical connector 1A to the lower side. Also, the direction in which the partner connector is withdrawn from the electrical connector 1A (i.e., the withdrawal direction) is the direction from the lower side of the electrical connector 1 to the upper side.

Figure 8:
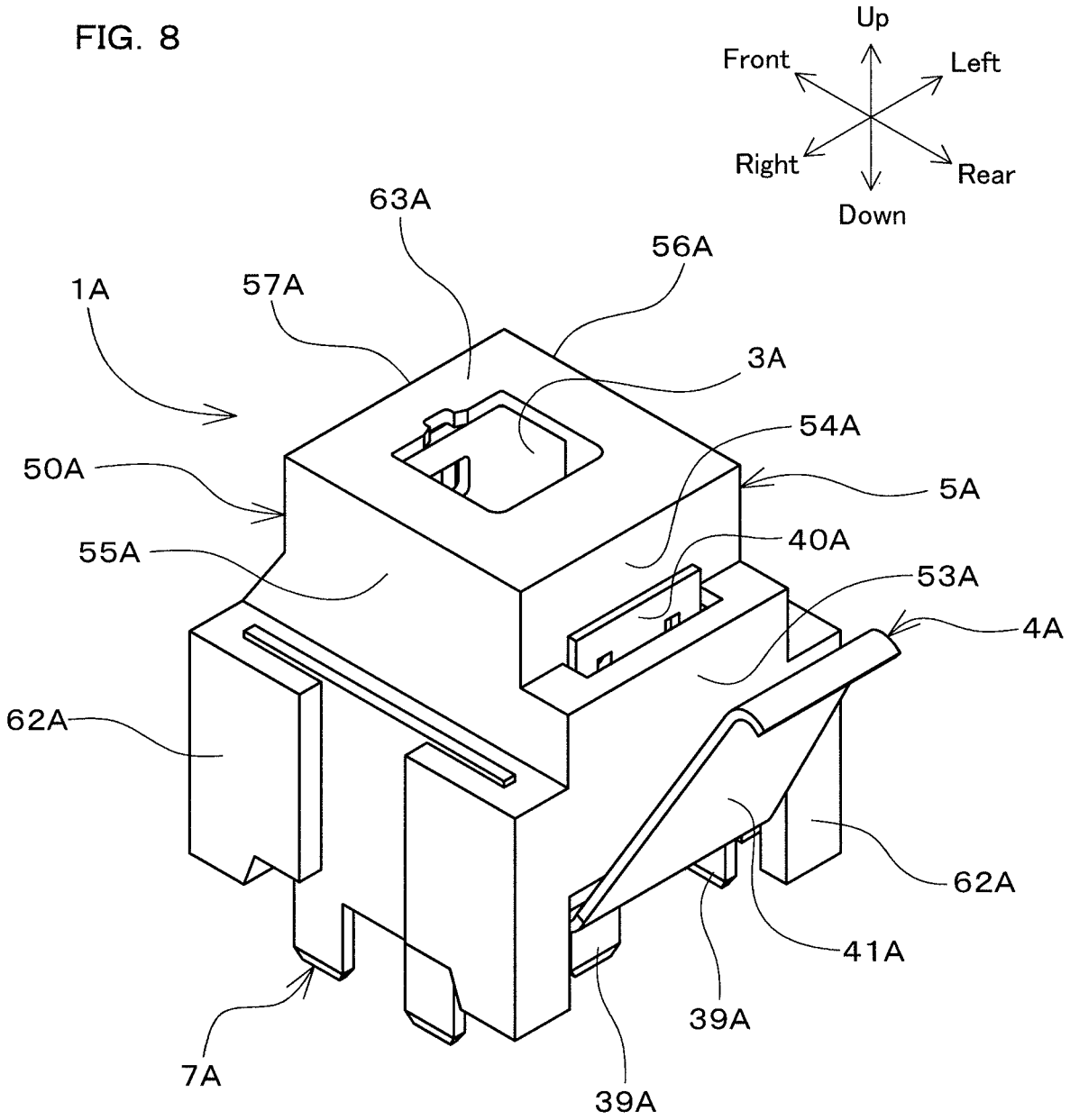
FIG. 8 is a perspective diagram showing an electrical connector according to a second embodiment of the present invention.
Figure 9:
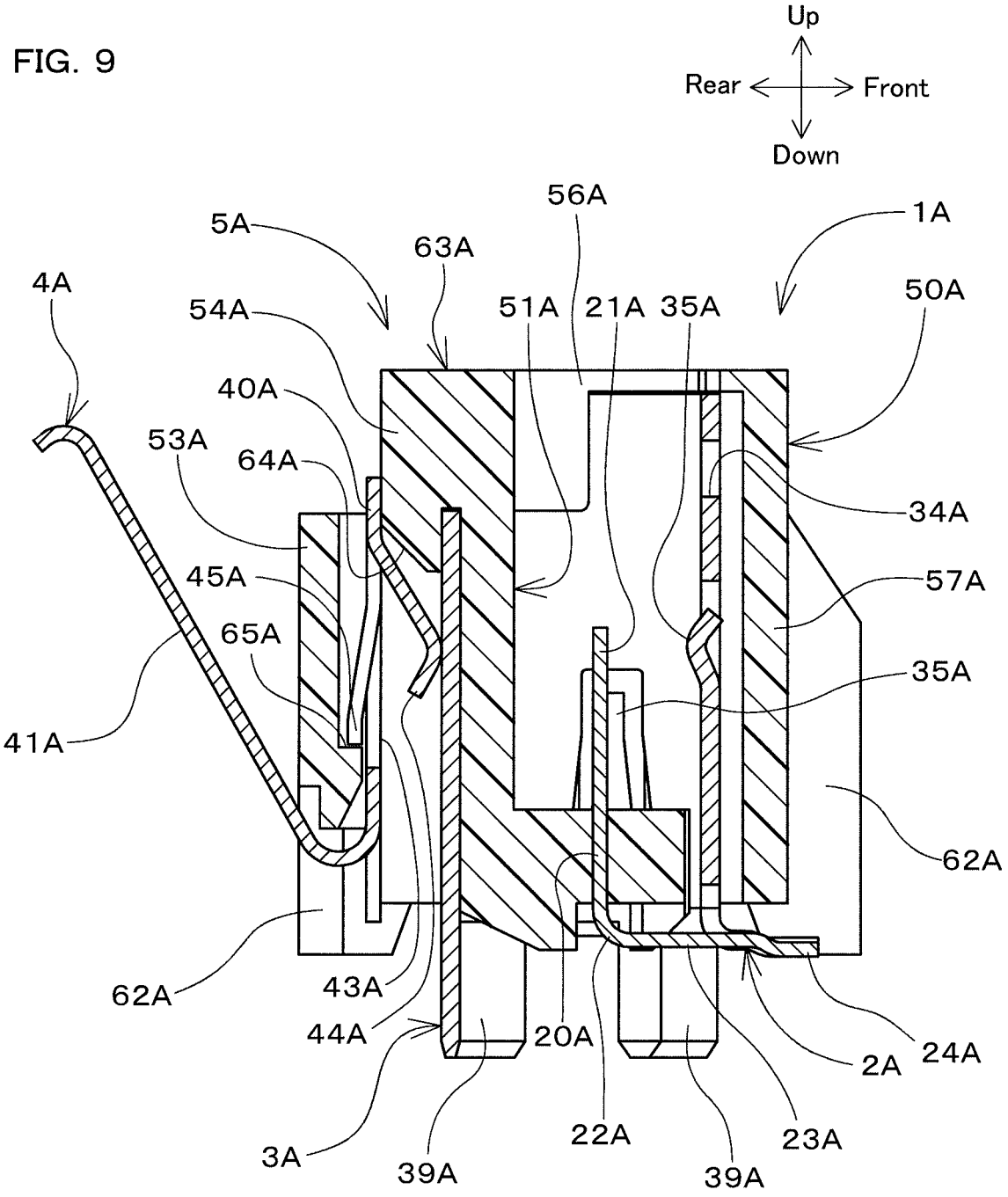
FIG. 9 is a cross-sectional diagram showing a cross-section taken along the height direction of the electrical connector shown in FIG. 8.

First, an overview of the electrical connector 1A will be described. FIG. 8 is a perspective diagram showing the electrical connector 1A according to the second embodiment. FIG. 9 is a cross-sectional diagram showing a cross-section taken along the height direction of the electrical connector 1A of the second embodiment.

The electrical connector 1A shown in FIGS. 8 and 9 is connected to a substrate (not shown) on the lower side, and is connected to an electrical cable (not shown) via a partner connector on the upper side.

The electrical connector 1A of the present embodiment is fixed to the substrate via tabs 7A that are arranged on the right side and the left side of a housing 5A. Note that although not shown in the drawings, the electrical connector 1A is connected to a partner connector on the upper side.

A contact 2A shown in FIG. 9 has a contact main body portion 20A, a contact portion 21A, a curved portion 22A, an extending portion 23A, and a substrate connection portion 24A.

The contact main body portion 20A of the present embodiment is press-fitted into a later-described inner housing portion 51A inside a shield member 3A. The contact portion 21A is provided on the upper side of the contact main body portion 20A, and extends substantially parallel with the central axis of the shield member 3A.

The curved portion 22A curves forward at the lower end of the contact main body portion 20A. The extending portion 23A extends forward from the curved portion 22A. The substrate connection portion 24A extends forward from the extending portion 23A, and extends substantially parallel to the substrate when the electrical connector 2A is connected to the substrate.

The shield member 3A shown in FIGS. 8 and 9 has a substantially rectangular tube shape. The shield member 3A has a cantilevered elastic contacting piece 35A for coming into contact with the partner shield member. The lower side of the shield member 3A is provided with a substrate fixing portion 39A for fixing the shield member 3A to the substrate, and a substrate ground portion (not shown) for grounding the shield member 3A to the substrate.

The upper side of the shield member 3A is provided with an engaging hole portion 34A for engagement with an engaging protrusion portion of the partner shield member. The elastic contacting piece 35A is formed with a cantilevered shape by performing cutting processing on the shield member 3A.

The substrate fixing portion 39A is electrically and mechanically connected to the substrate by soldering. The electrical connector 1A is fixed to the substrate due to the substrate fixing portion 39A being connected to the substrate.

The substrate ground portion extends forward from the shield member 3A, and extends substantially parallel to the substrate when the electrical connector 2A is connected to the substrate. The substrate ground portion is electrically connected to the substrate by welding.

A ground spring member 4A shown in FIGS. 8 and 9 includes a main body portion 40A and a plate spring portion 41*k* The main body portion 40 is provided with a contacting spring portion 44A and a locking portion 45A for locking the ground spring member 4A to the housing 5A.

The contacting spring portion 44A is formed in the shape of a cantilevered plate by performing cutting processing on an approximately central portion of the main body portion 40A. The contacting spring portion 44A extends from one end portion side of the main body portion 40A toward the side on which the plate spring portion 41A is connected to the main body portion 40A, and is inclined toward the shield member 3A. In other words, the contacting spring portion 44A extends from the upper side to the lower side, and is inclined toward the front side. Also, the leading end portion of the contacting spring portion 44A has been bent toward the side opposite to the shield member.

The locking portion 45A is provided adjacent to the contacting spring portion 44A in the left-right direction, and is formed with a cantilevered shape by performing cutting processing on the main body portion 40A. The locking portion 45A extends from one end portion side of the main body portion 40A toward the side on which the plate spring portion 41A is connected to the main body portion 40A. In other words, the locking portion 45A extends from the upper side to the lower side. Also, the base of the locking portion 45A has been bent rearward. The leading end portion of the locking portion 45A has been bent so as to be parallel with the main body portion 40.

The housing 5A shown in FIGS. 8 and 9 is constituted to include a portion that is substantially shaped as a tube having a predetermined thickness. The housing 5A also has ground spring mount portions 53A for mounting of the ground spring member 4A, on the rear side. The housing 5A furthermore has tab housing portions 62A for housing the substantially plate-shaped tabs 7A, on the right side and the left side. The housing 5A is fixed to the substrate via the tabs 7A that are housed in the tab housing portions 62A.

The housing 5A has an outer housing portion 50A arranged outside of the shield member 3A. The housing 5A also has an inner housing portion 51A arranged inside of the shield member 3A. The housing 5A further has a joining portion 63A that integrally joins the outer housing portion 50A and the inner housing portion 51A, at the end portion on the side that is connected to the partner connector by mating therewith.

The outer housing portion 50A shown in FIGS. 8 and 9 is approximately shaped as a tube that extends in the up-down direction, and more specifically is approximately shaped as a rectangular tube. The outer housing portion 50A is provided with a first wall portion 54A, a second wall portion 55A, a third wall portion 56A, and a fourth wall portion 57A, and these wall portions (54A. 55A, 56A, and 57A) are continuous and integrated with each other in the circumferential direction.

The first wall portion 54A is provided in the upper portion of the outer housing portion 50*k* The second wall portion 55A is provided in the rightward portion of the outer housing portion 50A. The third wall portion 56A is provided in the leftward portion of the outer housing portion 50A. The fourth wall portion 57A is provided in the rightward portion of the outer housing portion 50A. Note that these wall portions (54A, 55A, 56A, and 57A) are arranged continuous with each other in the circumferential direction in the order of the fourth wall portion 57A, the second wall portion 55A, the first wall portion 54A, and the third wall portion 56A, beginning with the front side of the housing 5A.

The first wall portion 54A is formed as an approximately plate-shaped portion having a predetermined thickness, and is provided with an opening portion 64A that is open downward in the central portion in the left-right direction. The opening portion 64A is formed in the lower side of the first wall portion 54A, and therefore a portion of the rearward side of the shield member 3A is not covered by the outer housing portion 50A. Also, the first wall portion 54A is integrally joined to the inner housing portion 51A via the joining portion 63A. The second wall portion 55A, the third wall portion 56A, and the fourth wall portion 57A are each configured as an approximately plate-shaped portion that has a predetermined thickness and extends in the up-down direction.

The joining portion 63A shown in FIGS. 8 and 9 is arranged at a location that is on the upper side and the rear side of the housing 5A, and integrally joins the first wall portion 54A and the inner housing portion 51A.

The ground spring mount portion 53A is provided so as to cover the opening portion 64A on the rear side of the first wall portion 54A. The ground spring mount portion 53A also has a locked portion 65A to which the locking portion 45A of the ground spring member 4A is locked in order to prevent the ground spring member 4A from coming out upward due to vibration or the like. The locked portion 65A is provided on the lower side of the ground spring mount portion 53A, namely on the surface that faces the main body portion 40A when the partner connector is connected to the electrical connector 1A. More specifically, the locked portion 65A is configured as the end portion of a groove that extends in the up-down direction in the surface on the side that faces the main body portion 40A, on the inner side of the ground spring mount portion 53A.

As described above, due to the ground spring member 4A being reliably locked to the housing 5A, it is possible to realize a configuration in which the ground spring member 4A is reliably held and stably grounded even if the plate spring portion 41A is subjected to a large load from above.

The present embodiment can also achieve effects similar to those of the previously described embodiment. Specifically, according to the present embodiment, it is possible to provide the electrical connector 1A that can have a simplified structure and small size, while also enabling selectively achieving a grounding function according to need without causing a decrease in shielding performance.

Although embodiments of the present invention have been described thus far, the present invention is not limited to the above-described embodiments, and various modifications can be made within the scope recited in the claims. In other words, the present invention is not limited to the above embodiments, and all modifications, applications, and equivalents thereof that fall within the claims, for which modifications and applications would become naturally apparent by reading and understanding the present specification, are intended to be embraced in the claims of the invention.

INDUSTRIAL APPLICABILITY

The present invention is broadly applicable as an electrical connector that has a grounding function for grounding to an external grounding member.

What is claimed is:

1. An electrical connector comprising:

a contact;

a housing configured to hold the contact;

a shield member configured to be held in the housing and block electromagnetic waves, the contact being arranged inside the shield member;

a ground spring member configured to ground the shield member; and a ground spring mount portion extending from the housing, wherein the ground spring member is comprised of a main body portion, a contacting spring portion, and a plate spring portion, the main body portion being substantially press-fitted into the ground spring mount portion, the contacting spring portion extending towards the housing and contacting the shield member, and the plate spring portion extending away from the housing, and wherein the ground spring member is configured to electrically connect the shield member and an external grounding member when the ground spring member is mounted to the ground spring mount portion.

2. The electrical connector according to claim 1, wherein the ground spring member has a main body portion that has a portion that is plate-shaped and configured to be mounted to the housing, and a plate spring portion that is provided integrated with the main body portion and is configured to come into contact with the external grounding member, and the main body portion is configured to come into contact with the shield member.

3. The electrical connector according to claim 2, wherein a press-fit groove configured to receive press-fitting of the main body portion is provided in the ground spring mount portion.

4. The electrical connector according to claim 2, wherein the main body portion has a plate-shaped portion configured as the portion that is plate-shaped, and a contacting spring portion that extends from the plate-shaped portion in a cantilevered manner, and that is configured to come into contact with the shield member.

5. The electrical connector according to claim 2, wherein the housing has a support portion that is provided with a flat surface configured to support the main body portion.

* * * * *